United States Patent [19]

Tavi

[11] Patent Number: 5,064,503

[45] Date of Patent: Nov. 12, 1991

[54] COMBINATION COMPRISING THE PRESS SECTION AND THE INITIAL PART OF THE DRYING SECTION IN A PAPER MAKING MACHINE

[75] Inventor: Seppo Tavi, Jyväskylä , Finland

[73] Assignee: Valmet Paper Machinery Inc., Finland

[21] Appl. No.: 513,552

[22] Filed: Apr. 24, 1990

[30] Foreign Application Priority Data

May 2, 1989 [FI] Finland ..... 892098

[51] Int. Cl.[5] ..... D21F 3/00

[52] U.S. Cl. ..... 162/359; 162/360.1; 34/117

[58] Field of Search ..... 162/206, 358, 359, 360.1, 162/290, 375; 34/272, 116, 117, 120

[56] References Cited

U.S. PATENT DOCUMENTS

| | | | |
|---|---|---|---|
| 2,892,263 | 6/1959 | Hornbostel | 34/120 |
| 3,286,360 | 11/1966 | Walker | 34/116 |
| 4,016,032 | 4/1977 | Kankaanpaa | 162/360.1 |
| 4,086,131 | 4/1978 | Rempel | 162/360.1 |
| 4,452,669 | 6/1984 | Koski | 162/360.1 |

FOREIGN PATENT DOCUMENTS

| | | | |
|---|---|---|---|
| 2052586 | 1/1981 | United Kingdom | 162/359 |

*Primary Examiner*—Karen M. Hastings

*Attorney, Agent, or Firm*—Steinberg & Raskin

[57] ABSTRACT

The combination of the press section and the initial part of a multi-cylinder drying section in a paper making machine wherein the press section comprises a compact press roll arrangement, whose rolls (16, 18, 20, 21) form press nips ($N_1$, $N_2$, $N_3$) with one another. The press section further comprises a separate press, whose press rolls (30, 31) form a press nip ($N_4$). The drying section of the combination comprises a multi-cylinder dryer comprising different cylinder groups (25, 39). Between the compact press roll arrangement and the separate press, a group of pre-drying cylinders (25) is fitted, said group being provided with a single-wire draw of the web (W) so that the upper cylinders (**25*a*, 25*b*, 25*c*) in the group (25) of pre-drying cylinders remain outside the loop of the drying wire (26), which accomplishes the single-wire draw. The web (W) is passed from the center roll (20) of the compact press section on the drying wire (26) substantially as a closed draw onto the press felt (33**) of the separate press, the felt being fitted as the lower felt in the separate press.

9 Claims, 2 Drawing Sheets

COMBINATION COMPRISING THE PRESS SECTION AND THE INITIAL PART OF THE DRYING SECTION IN A PAPER MAKING MACHINE

BACKGROUND OF THE INVENTION

The invention concerns a combination of the press section and the initial part of a multi-cylinder drying section in a paper making machine, said press section comprising a compact press roll arrangement, whose rolls form press nips with one another, and said press section further comprising a separate press, whose press rolls form a press nip, and the drying section in said combination comprising a multi-cylinder dryer consisting of different cylinder groups.

As is well known, in paper or paperboard making machines press sections are commonly used which comprise a compact press roll combination followed by a separate press nip. Examples of compact press sections include the applicant's "Sym-Press II" ( TM ) and "Sym-Press O" ( TM ) press sections, in connection with which it is possible to use a separate press nip, or if such a nip is used, in the paper machine space usually can be reserved for a separate nip so that such a nip can be introduced later relatively easily.

In the prior art press sections, problems have occurred in the transfer of the web from the center roll of the compact press roll to the separate press. As is well known, this transfer has taken place by means of a paper guide roll fitted in proximity to the center roll in the press and by means of a suction roll placed underneath said paper guide roll, the lower felt in the separate nip running over said suction roll. On the substantially horizontal run of the lower felt, even though means of negative pressure have been arranged inside the loop of the felt, detaching of the web from the lower felt as a result of blowing has occurred, which has caused web breaks. These problems concerning web draw have been aggravated with increasing running speeds of paper machines.

Moreover, in the prior art draws between a compact press section and a separate press, a problem existed in the handling of broke, this problem arising primarily from congested space. For the purposes of this application "broke" can be defined as partly or completely manufactured paper or paperboard that does not leave the machine as saleable paper or paperboard. In said prior-art draws, a separate broke conveyor has been necessary, and for the conveyor an opening must be provided in the frames of the machine at the operation side. It is difficult to place such a conveyor in a congested space.

In an arrangement known in the prior art, the separate nip is supported on frame parts, which are directly connected to the rest of the frame part of the press section. Thus, in the separate press, some of the same frame parts are employed as in the preceding compact press section. This frame arrangement has resulted in a problem wherein oscillations are transferred from frame parts to other frame parts. These problems are aggravated by the fact that, owing to the small space that is available, the various frame parts cannot always be constructed to be sufficiently rigid to withstand the occurrence of these vibrations.

Attempts have been made to control such draw and blow problems by means of suction rolls, suction boxes, and various doctor arrangements as well as by, before the nip of the separate press, providing a certain covering angle which reduces the vibration of the web before the separate nip. However, by means of these arrangements, it is not possible to control said problems completely, because, for example, when suction rolls and suction boxes are used, the suction effect becomes weaker when the permeability of the lower felt in the separate nip is increased during operation.

It is known in the prior art to employ drying of the web between separate nips. In this respect, reference is made to the Applicant's FI Pat. Appl. 763761, to the SE Patent 97,609, and to the book by Gunnar Gavelin, *Fourdrinier Papermaking* 1963, page 125, FIG. 5, "Arrangement for a suction hot press". At the time of the above cited papers, the running speeds of paper machines were, however, so relatively low that the problems discussed above and related to the draw of the paper web did not occur. Nor were compact press sections in connection with a separate press known at that time.

SUMMARY OF THE INVENTION

The general object of the present invention is to provide a novel fitting and combination between the press section and the initial part of the drying section so that the problems discussed above can be avoided even with relatively high running speeds of the machine.

It is a particular object of the invention to provide such a combination between a press section and the initial part of a drying section such that a relatively long uncontrolled transfer of the web on a felt is avoided.

An additional object of the present invention is to provide such a combination between a press section and a drying section whose frame can be easily constructed to be more rigid so that oscillations are reduced.

It is a particular object of the present invention to provide such a combination between a press section and the initial part of a drying section wherein the handling of broke becomes easier, because space is provided more favorably for a broke conveyor or the handling of broke can be arranged manually more easily than in the prior art.

It is additional another additional object of the invention to provide such an arrangement of the draw of the web from the press section to the drying section as is more suitable for modernizations of paper machines so that the prior art compact press sections (Sym-Press II and Sym-Press O) can be provided with a separate press more advantageously than in the prior art without the necessity for making substantial modifications to the frame parts. In relation to this arrangement, a further object of the invention is to provide a combination structure of this type in which space can be provided in reserve for a separate press to provide more favorable results than in the prior art.

It is a further object of the invention to provide such a combination between the press section and the initial part of the drying section wherein dewatering can be intensified in the separate press.

With a view to achieving the objects stated above and those that will become apparent in the rest of this specification, the invention is mainly characterized in that, between the compact press roll arrangement and the separate press, a group of pre-drying cylinders is fitted, which group is provided with a single-wire draw of the web so that the upper cylinders in the group of pre-drying cylinders remains outside the loop of the drying wire, which accomplishes the single-wire draw, and that the web is passed from the compact press section, most appropriately from its center roll, on said drying wire substantially as a closed draw onto the press felt of the separate press, said felt being fitted as the lower felt in the separate press.

BRIEF DESCRIPTION OF THE DRAWINGS

In the following, the invention will be described in detail with reference to some preferred exemplifying embodiments of the invention illustrated in the figures in the accompanying drawing, the invention not being not confined to the details of said embodiments.

DESCRIPTION OF THE PREFERRED EMBODIMENTS

Figure 1:
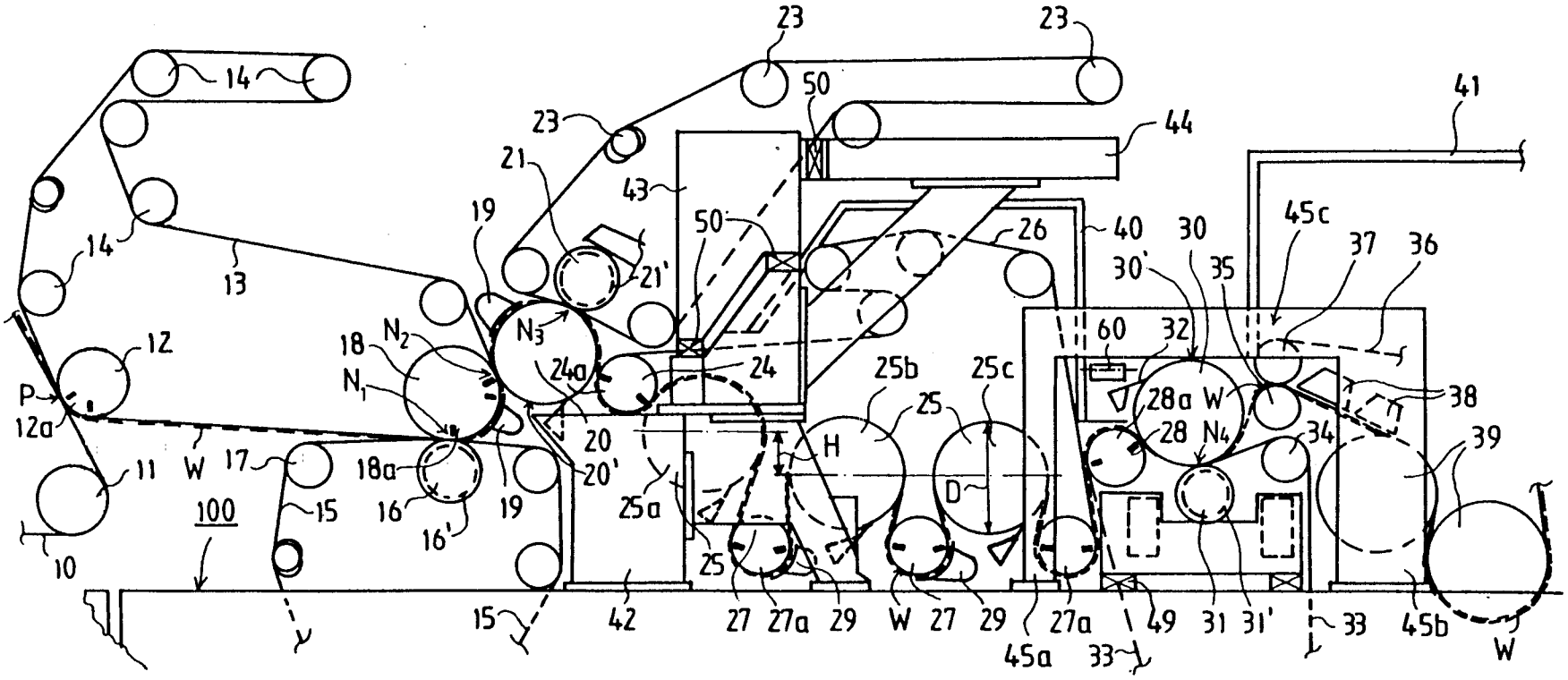
FIG. 1 is a schematical side view of a press section and the initial end of a drying section in accordance with the invention.

As is shown in FIG. 1, the paper web W, which has been formed on the wire 10, is transferred at the pick-up point P, before the wire-drive roll 11, on the suction zone 12*a* of the pick-up roll 12 onto the upper felt 13, which is guided by guide rolls 14. The upper felt 13 passes the web W on its lower face into the first nip $N_1$ in the closed press section, said nip being formed between the suction roll 18 and the hollow-faced 16' lower roll 16. The nip $N_1$ is a two-felt nip, and the lower felt 15, which is guided by the guide rolls 17, runs through the nip. After the nip $N_1$, the web W follows the upper felt 13 by the effect of the suction zone 18*a* of the suction roll 18 being transferred into the second nip $N_2$, which is formed between the suction roll 18 and the center roll 20 of the press. On the suction sector 18*a* of the suction roll 18, there is a steam box 19. A second steam box 19 is placed between the second nip $N_2$ and the third nip $N_3$. After the second nip $N_2$, the web W follows the smooth face 20' of the center roll 20 and enters into the third nip $N_3$, which is formed with the center roll 20 and the hollow-faced 21' press roll 21. The press felt 22 guided by the guide rolls 23 runs through the third nip $N_3$.

After the third nip $N_3$ the web W follows the smooth face 20' of the center roll 20, from which it is detached by the effect of the vacuum effect in the suction zone 24*a* of the transfer-suction roll 24 while making use of a very short open draw. A drying wire 26, guided by the guide roll 26*a*, is passed over the suction roll 24.

The compact press section described above is known in the prior art and marketed by the Applicant with the trade mark "Sym-Press II".

As is shown in FIG. 1, the drying wire 26 is included in a preliminary group 25 of drying cylinders, which comprises three drying cylinders 25*a*, 25*b*, 25*c*. The web W is passed over said cylinders as a single-wire draw from the transfer-suction roll 24 on the drying wire 26, so that the web W reaches direct contact with the steam-heated faces of the drying cylinders 25. In the pre-drying group 25, the first cylinder 25*a* is placed somewhat higher than the next cylinders 25*b* and 25*c*, which are placed on the same level as compared with each other, and the difference in height is denoted with H in FIG. 1. This difference in height H is, for example, H=500 mm when the diameter of the drying cylinders 25 is D=1500 mm.

In the lower gaps between the cylinders in the pre-drying group 25, guide rolls 27 are placed, which are provided with suction zones 27*a* and over which the drying wire 26 runs while the web W remains at the side of the outside curve on the sector a (a>180°). On the suction zones 27*a*, steam boxes 29 are provided, which heat the web W from the outside. On the lower faces of the cylinders 25*a*, 25*b*, 25*c*, there are doctors, which clean the cylinder faces and, when necessary, remove broke into the pulper placed underneath or onto the broke conveyor (not shown).

The last cylinder 25*c* in the pre-drying group 25 is followed by a guide roll 27*a*, which is provided with a suction zone 27*a* and in whose area the runs of the web W and of the wire 26 are turned upwards. Hereupon the web W is transferred onto the lower felt 33 of the separate press, said felt 33 being passed over the transfer-suction roll 28 to the proximity of the upwardly directed run of the drying wire 26. The web W is transferred onto the lower felt 33 on the field of negative pressure produced by the suction zone 28*a* of the transfer-suction roll 28. The suction-transfer roll 28 is placed at the proximity of the smooth-faced 30+ upper roll of the separate press so that there is a small gap between them.

The nip in the separate press, which is the fourth nip $N_4$ in the press section, is formed between said upper roll 30 and the hollow-faced 31' lower roll 31. After the nip $N_4$ the web W follows the smooth face 30' of the upper roll 30, from which it is separated on the paper guide roll 35 and is transferred onto the drying wire 36 of the drying section proper, the guide roll 37 of said drying wire 36 being placed above the paper guide roll 35. The web W is made to adhere to the drying wire 36 on the field of negative pressure of the suction boxes 38. The drying wire 36 carries the web W further to the first single-wire draw group proper in the drying section, of which only the first two drying cylinders 39 are shown in FIG. 1.

According to the invention, the drying cylinders 25*a*, 25*b*, 25*c* form a pre-drying cylinder group 35 and, for their part, provide a favorable transfer of the web from the compact press section to the separate press. In the pre-drying group 25, water that has remained in the web W after the compact press is heated; the viscosity of the water present in the web and its elastic properties are changed so that the dewatering is intensified in the separate nip $N_4$. Actually, the pre-drying group does not dry the web, but it just heats it in order for the press to dewater the web more efficiently by pressing.

Of the frame constructions of the compact press section, FIG. 1 shows the frame part 42 as well as the upper frame 43, to which the horizontal frame 44 is connected, below which said horizontal frame 44 there is the pre-drying group 25. The pre-drying group 25 is provided with a hood 40 of its own for the recovery of heat and for air-conditioning. The drying section proper, which follows after the separate press, is provided with a separate hood 41 of its own. Of the frame part of the separate press, FIG. 1 shows the vertical frame 45*a* and 45*b* as well as the horizontal frame 45*c* that interconnected them.

Figure 2:
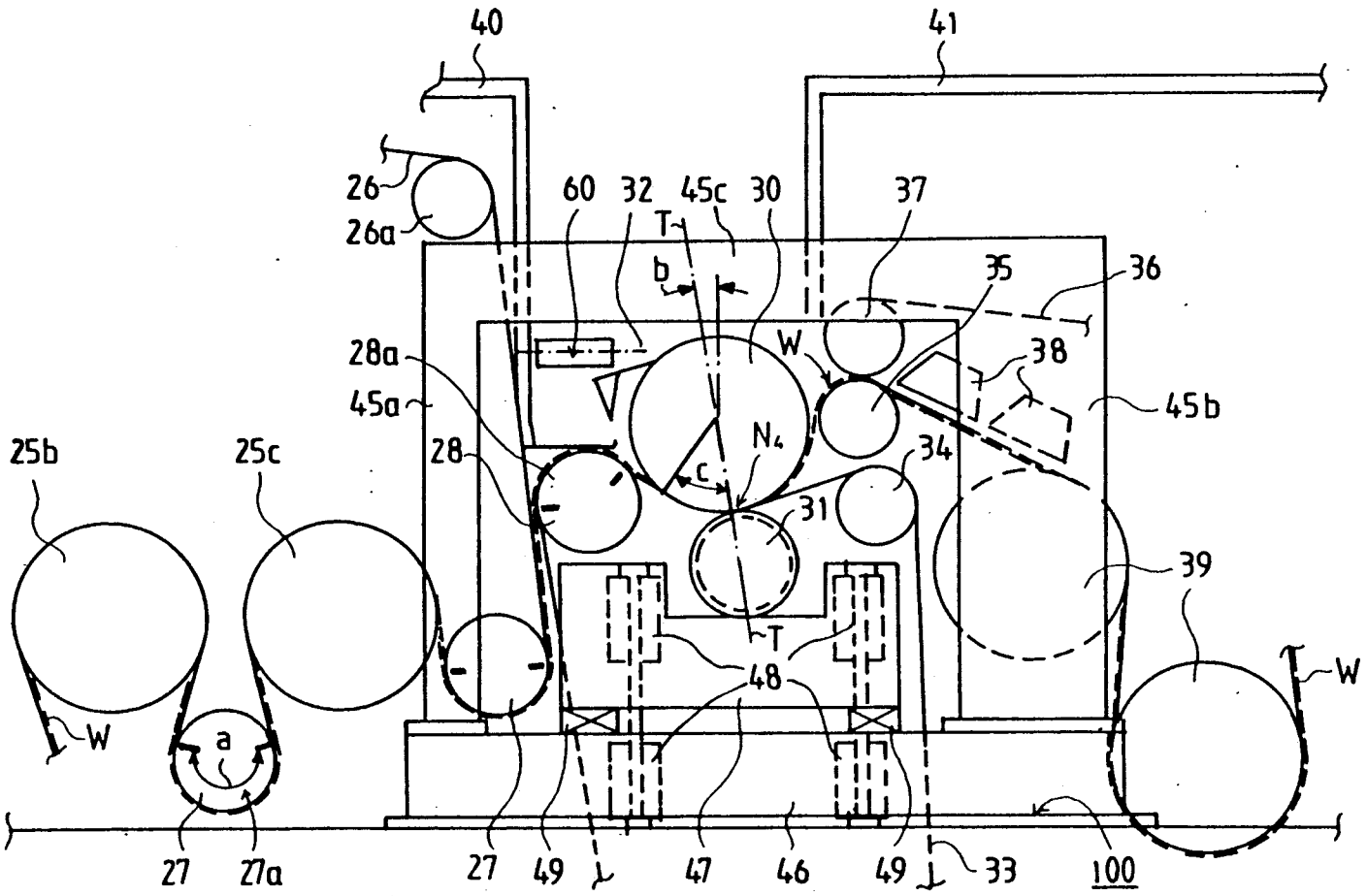
FIG. 2 shows a separate-press arrangement in accordance with the invention, together with its frame part.

FIG. 2 shows the separate press and a preferred frame part thereof on an enlarged scale. The frame part of the separate press shown in FIG. 2 is fully separate from the frame part of the compact press, so that oscillations cannot be transferred from one frame part to the other. The frame part shown in FIG. 2 is particularly well suited for use in modernizations, and therein a horizontal base part 46 has been made on the foundation 100 of the paper machine hall, on which said base part 46 the vertical frames 45*a* and 45*b* are supported, whose upper ends are interconnected by the horizontal frames 45*c*. When the base part 46 is used, the foundation 100 of the paper machine hall does not have to be renewed or reinforced in any particular way. The frame design shown in FIG. 2 is known as a so-called C-frame, and it can be made relatively rigid. The lower roll 31 in the separate press is journaled on the frame part 47. The frame parts 47 and base parts 46 placed at the service side and at the operation side of the paper machine are interconnected by cantilever beams 48. Between the frame parts 46 and 47, there are openable spacer pieces 49, through which the lower felt 33 can be replaced. In FIG. 1, the frame part of the compact press is provided with corresponding openable spacer pieces 50.

As is shown in FIG. 2, at the rear side of the upper portion of the circumference of the upper roll 30 in the separate press, there is a doctor 32, which keeps the smooth face 30' of the roll 30 clean and removes broke, for which purpose there is a broke conveyor 60 in connection with the doctor 32, said conveyor removing broke in the transverse direction and transferring it to the side of the paper machine and from there further into the pulper.

As is shown in FIG. 2, the suction sector 28 of the transfer-suction roll 28 extends substantially across the entire turning sector of the web W. After the suction sector 28, the lower felt 33 and the web W supported on it are transferred, on the sector c, in contact with the face 30' of the upper roll 30, so that the run of the web W has time for its vibrations to be lessened before the fourth nip $N_4$. The fourth nip $N_4$ is slightly "inclined" so that its plane T—T forms a small angle b with the vertical plane. By means of this inclination, a more favorable draw of the web W into the press nip $N_4$ is obtained.

Although preferred embodiments of the subject invention have been shown herein, it is submitted that numerous other embodiments within the scope of the appended claims will readily occur to those skilled in the art.

What is claimed is:

1. A combination in a paper or paperboard making machine, said combination comprising:

a press section comprising a compact press roll arrangement comprising at least three press rolls with each of said at least three press rolls forming a press nip with another of said at least three press rolls and a separate press arrangement comprising at least two press rolls forming a press nip with each other and located remote from said compact press roll arrangement so as to not form a press nip with any of said at least three press rolls, and said separate press arrangement comprising at least one press felt;

a drying section comprising a plurality of cylinder groups, one of said cylinder groups comprising a plurality of pre-drying cylinders and said one of said cylinder groups being located between said compact press roll arrangement and said separate press arrangement; and a drying wire forming a loop and structured and arranged to facilitate a single wire draw for a paper or paperboard web issuing from said compact press roll arrangement, said plurality of pre-drying cylinders comprising a plurality of upper cylinders which are located outside of said wire loop and which also facilitate said single wire draw for said paper or said paperboard web, and said drying wire structured and arranged to pass said paper or paperboard web substantially as a closed draw onto said at least one press felt of said separate press arrangement;

further comprising first and second frame parts separate from each other, the first of said frame parts being connected to said compact press roll arrangement and the second of said frame parts being connected to said separate press arrangement; and wherein said second frame part directly connected to said separate press arrangement comprises a C-shaped frame which is open in a downward direction and which C-shaped frame comprises a pair of substantially vertical parts and a substantially horizontal part connecting said pair of substantially vertical parts, and said combination further comprises a foundation of the paper or paperboard making machine and a plurality of base-frame parts mounted on said foundation and directly connected to respective lower ends of said pair of vertical parts of said C-shaped frame.

2. The combination of claim 1 wherein said compact press roll arrangement comprising at least three press rolls comprises a first press roll, a second press roll, a third press roll, and a fourth press roll, said first and second press rolls forming therebetween a first press nip, said second and third rolls forming therebetween a second press nip, and said third and fourth press rolls forming a third press nip.

3. The combination of claim 2, further comprising a first transfer suction roll located proximately to said third press roll, said third press roll being a center press roll of said compact press roll arrangement, said first transfer suction roll functioning to transfer said web from said center press roll onto a first cylinder of said one of said cylinder groups comprising said plurality of pre-drying cylinders, and said combination further comprising a second transfer suction roll located proximately to a last cylinder of said one of said cylinder groups comprising a plurality of pre-drying cylinders, said second transfer suction roll functioning to receive said web from said last cylinder, and said second transfer suction roll having a suction zone wherein said web is detached from said drying wire and transferred via said at least one press felt to one of said at least two press rolls of said separate press arrangement, said one of said at least two press rolls being smooth-faced and being proximately located to said second transfer suction roll.

4. The combination of claim 1, further comprising at least one turning roll placed between two of said plurality of pre-drying cylinders and functioning to turn said drying wire and said web thereon by a angle of at least 180 degrees.

5. The combination of claim 1, wherein another one of said cylinder groups of the drying section comprises a multi-cylinder dryer located such that said web passes therethrough after leaving said separate press section, said combination further comprising said multi-cylinder drying and said one of said cylinder groups having respective first and second hoods, said hoods being separate from each other.

6. The combination of claim 3, wherein said web is detached from a rear-side sector of said center roll as a short open draw and is transferred onto a suction zone of said first suction transfer roll over which said drying wire passes.

7. The combination of claim 3, wherein said web is detached from a rear side sector of said center roll by means of a transfer nip and is transferred onto a suction zone of said first suction transfer roll over which said drying wire passes.

8. The combination of claim 1, wherein the first of said plurality of said pre-drying cylinders in the path of said web is located at a higher level than all other cylinders of said plurality of said pre-drying cylinders.

9. The combination of claim 1, wherein one of said at least two rolls of said separate press arrangement is smooth-faced and functions as the upper roll of said at least two press rolls and said combination further comprises a doctor connected to said upper roll and a transverse broke conveyor placed in proximity to said doctor and functioning to convey broke away from said web.

* * * * *